US010151491B2

(12) United States Patent
Cadima

(10) Patent No.: US 10,151,491 B2
(45) Date of Patent: Dec. 11, 2018

(54) COOKTOP WITH AN INTERCHANGEABLE GAS BURNER ASSEMBLY

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 374 days.

(21) Appl. No.: 15/076,698

(22) Filed: Mar. 22, 2016

(65) Prior Publication Data

US 2017/0276373 A1 Sep. 28, 2017

(51) Int. Cl.
*F24C 3/08* (2006.01)
*F24C 3/10* (2006.01)

(52) U.S. Cl.
CPC . *F24C 3/08* (2013.01); *F24C 3/10* (2013.01)

(58) Field of Classification Search
CPC .. F23D 14/26; F23D 14/06; F24C 3/08; F24C 3/10
See application file for complete search history.

(56) References Cited

U.S. PATENT DOCUMENTS 4,705,019 A 11/1987 Beach et al.
7,881,593 B2 2/2011 Grassi et al.
2010/0005976 A1 1/2010 Inzaghi

*Primary Examiner* — Alfred Basichas
(74) *Attorney, Agent, or Firm* — Dority & Manning, P.A.

(57) ABSTRACT

A cooktop and appliance is provided that may include a first hob zone having a fixed gas receptacle, a first interchangeable burner, a second interchangeable burner, and a first gas flow switch. The first interchangeable burner may be selectively positionable at the first hob zone and define a fuel output area. The second interchangeable burner may also be selectively positionable at the first hob and may define a fuel output area smaller than the fuel output area of the first interchangeable burner. The first gas flow switch may be disposed at the first hob zone to selectively engage one of burners. The first gas flow switch may include a valve upstream of the fixed gas receptacle to selectively restrict gas flow upon engagement of the first gas flow switch with one of the first interchangeable burner or the second interchangeable burner.

20 Claims, 7 Drawing Sheets

COOKTOP WITH AN INTERCHANGEABLE GAS BURNER ASSEMBLY

FIELD OF THE INVENTION

The present subject matter relates generally to cooktop appliances, such as gas cooktop appliances with burners.

BACKGROUND OF THE INVENTION

Generally, gas cooktop appliances include a plurality of gas burners mounted to a top surface of the appliance. Multiple burners of differing sizes or shapes may be provided in a single appliance. As a result, a single appliance may accommodate utensils (e.g., pots or pans) of varying sizes. Relatively smaller burners may be configured to support and heat relatively small utensils, while relatively large burners are configured to support and heat relatively large utensils.

Although having burners of varying sizes may allow users to more effectively heat utensils of differing shapes, the placement of the burners may limit the cooking options available. For instance, existing appliances often have a fixed burner configuration. A typical appliance may include a relatively large burner near the front of the appliance for easier access during use. Relatively small burners, by contrast, may be positioned toward the rear of the appliance since the weight and mass of objects placed on the small burners is generally much lower than the weight and mass of objects placed on the larger burners. The objects on the smaller burners can, thus, be moved on or off the burner without undue strain to the user. Nonetheless, some users may not prefer this configuration. As an example, under certain conditions, some users may desire to have the largest burner toward the rear of the appliance and out of the reach of small children. Moreover, a wide-range of additional or alternative burner configurations may be desirable according to the needs of individual users.

Although certain existing appliances provide for some variation in the positioning of their burners, such systems may be unduly complex and burdensome to reposition. In the field of gas burner appliances, burners of different sizes and shapes generally require different configurations for proper operation (e.g., to ensure ignition and supply a desired heat output). Changing the size or location of a burner may require reconfiguring the placement of igniters and accounting for the differences in fuel delivery, among other considerations. It may be difficult for all the necessary considerations to be accounted for in a manner that is both quick and reliable.

Accordingly, a cooktop appliance with features for facilitating changing a burner location and/or size may be desirable. In addition, a cooktop appliance with features for easily and reliably changing burner size would be useful.

BRIEF DESCRIPTION OF THE INVENTION

Aspects and advantages of the invention will be set forth in part in the following description, or may be obvious from the description, or may be learned through practice of the invention.

In one aspect of the present subject matter, a cooktop is provided. The cooktop may include a first hob zone having a fixed gas receptacle, a first interchangeable burner, a second interchangeable burner, and a first gas flow switch. The first interchangeable burner may be selectively positionable at the first hob zone to operably communicate with the fixed gas receptacle. The first interchangeable burner may define a fuel output area. The second interchangeable burner may be selectively positionable at the first hob zone to operably communicate with the fixed gas receptacle. The second interchangeable burner may define a fuel output area smaller than the fuel output area of the first interchangeable burner. The first gas flow switch may be disposed at the first hob zone to selectively engage one of the first interchangeable burner or the second interchangeable burner. The first gas flow switch may include a valve upstream of the fixed gas receptacle to selectively restrict gas flow upon engagement of the first gas flow switch with one of the first interchangeable burner or the second interchangeable burner.

In another aspect of the present subject matter, a cooktop is provided.

The cooktop may include a first and second hob zone, a first and second interchangeable burner, and a first gas switch. The first hob zone may include a fixed gas receptacle. The fixed gas receptacle of the first hob zone may include a primary gas aperture and an alternate gas aperture. The second hob zone may also include a fixed gas receptacle. The fixed gas receptacle of the second hob zone may include a primary gas aperture and an alternate gas aperture. The first interchangeable burner may define a fuel output area. Moreover, the first interchangeable burner may be selectively positionable at the first hob zone and the second hob zone in operable communication with the respective fixed gas receptacle. The second interchangeable burner may define a fuel output area smaller than the fuel output area of the first burner. Furthermore, the second interchangeable burner may be selectively positionable at the first hob zone and the second hob zone in operable communication with the respective fixed gas receptacle. The first gas flow switch disposed at the first hob zone to selectively engage one of the first interchangeable burner or the second interchangeable burner. The first gas flow switch may include a valve operably connected to the alternate gas aperture of the first hob zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
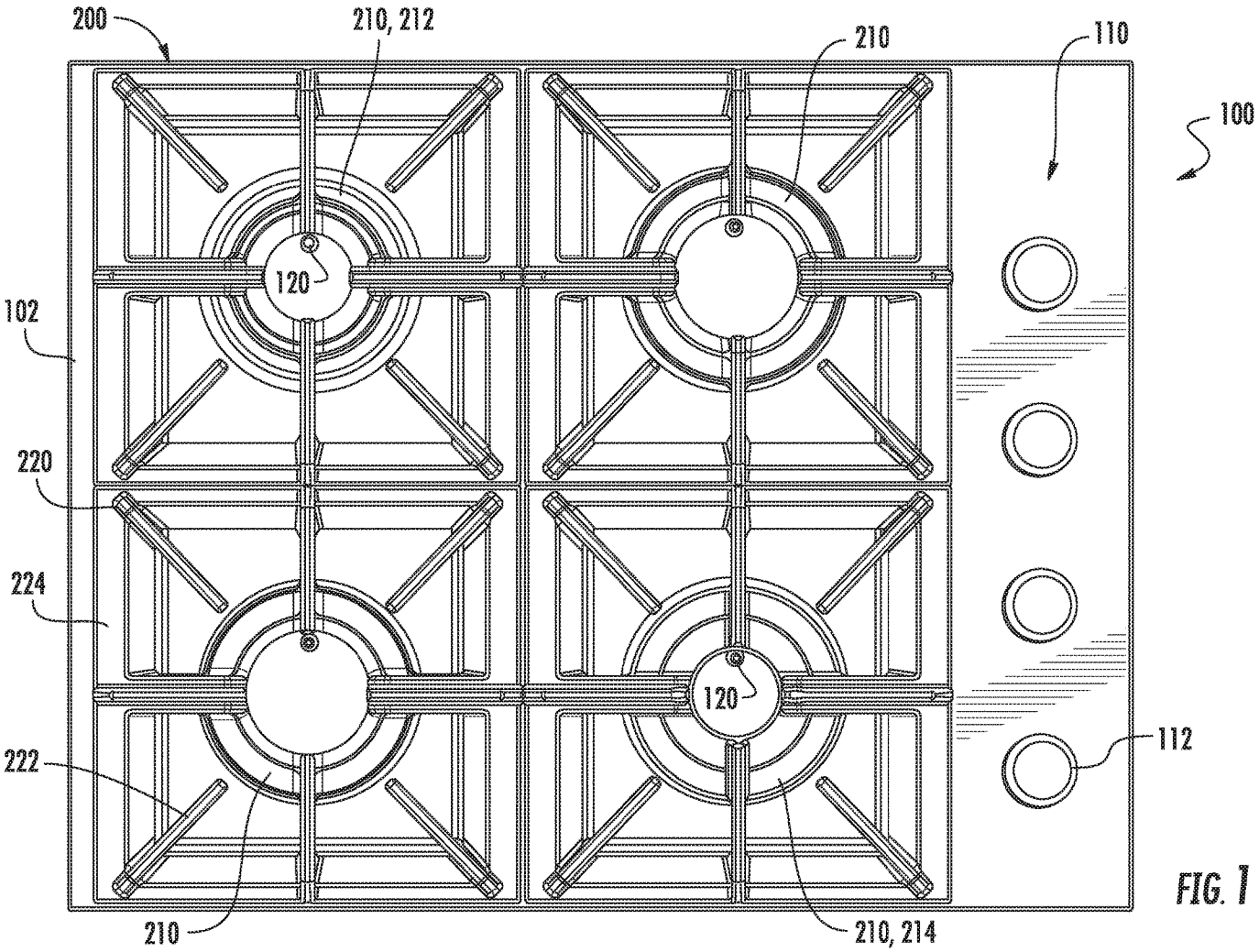
FIG. 1 provides a top view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter provides an appliance with multiple interchangeable burners. The burners may be of different sizes and/or flame shapes. As a result, a small burner may be easily moved to the location of a larger burner, and vice versa. One or more features, such as a switch, may detect the size/shape of the burner and automatically adjust the appliance to accommodate the detected interchangeable burner.

FIG. 1 illustrates an exemplary embodiment of a cooktop appliance 100 as may be employed with the present subject matter. The cooktop appliance 100 includes a panel 102, e.g., a top panel. By way of example, the panel 102 may be constructed of enameled steel, stainless steel, glass, ceramics, or combinations thereof. Moreover, multiple hob zones 104, 106 may be defined on the panel 102 to receive a gas burner assembly 200, as will be described below.

For the exemplary cooktop appliance 100, a utensil holding food and/or cooking liquids (e.g., oil, water, etc.) may be placed onto one or more of the hob zones 104, 106. Specifically, the utensil may be placed on a gas burner assembly 200 provided at a certain hob zone. The gas burner assemblies 200 can be configured in various sizes so as to provide, among other things, for the receipt of cooking utensils (e.g., pots, pans, etc.) of various sizes and configurations and provide heat inputs for the cooking utensils thereon.

A user interface panel 110 is located within convenient reach of a user of the cooktop appliance 100. For this exemplary embodiment, the user interface panel 110 includes knobs 112 that are each associated with one of the gas burner assemblies 200. The knobs 112 allow the user to activate each burner assembly 200 and determine the amount of heat input provided by each gas burner assembly 200 at one or more burners 210 to a cooking utensil located thereon. The user interface panel 110 may also be provided with one or more graphical display devices that deliver certain information to the user such as, e.g., whether a particular burner assembly 200 is activated and/or the level at which the burner assembly 200 is set.

Operation of the cooking appliance 100 can be regulated by a controller (not shown) that is operatively coupled i.e., in communication with, user interface panel 110 and/or gas burner assemblies 200. For example, in response to user manipulation of the knobs 112 of user interface panel 110, the controller operates one of the burner assemblies 200. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. For example, the controller may be located under or next to the user interface panel 110. In such an embodiment, input/output ("I/O") signals are routed between the controller and various operational components of appliance 100, such as gas burner assemblies 200, user interface panel 110, sensors, graphical displays, and/or one or more alarms. In one embodiment, the user interface panel 110 may represent a general purpose I/O ("GPIO") device or functional block.

Figure 2:
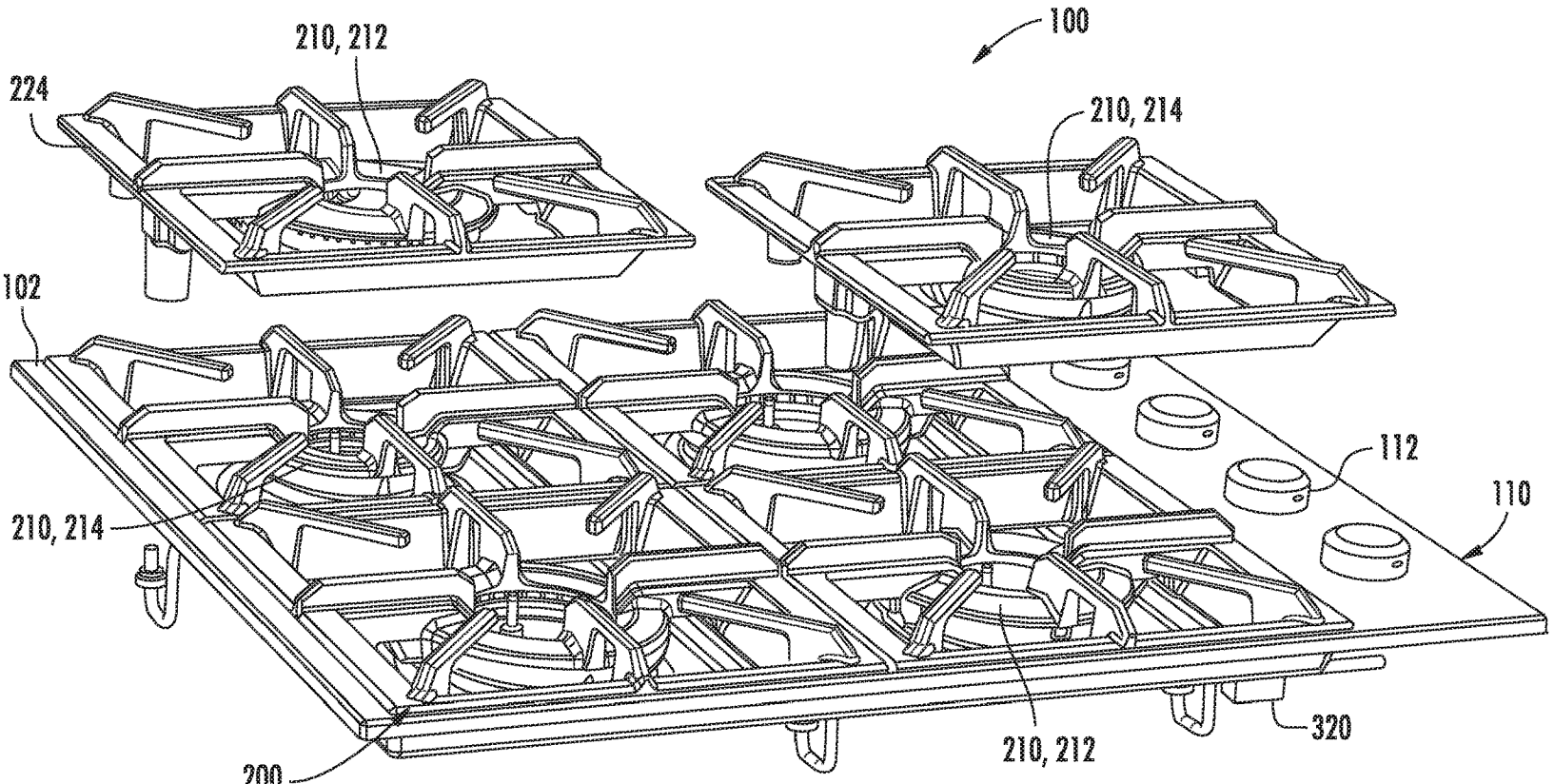
FIG. 2 provides a perspective view of the exemplary cooktop appliance according to the exemplary embodiment of FIG. 1.
Figure 3:
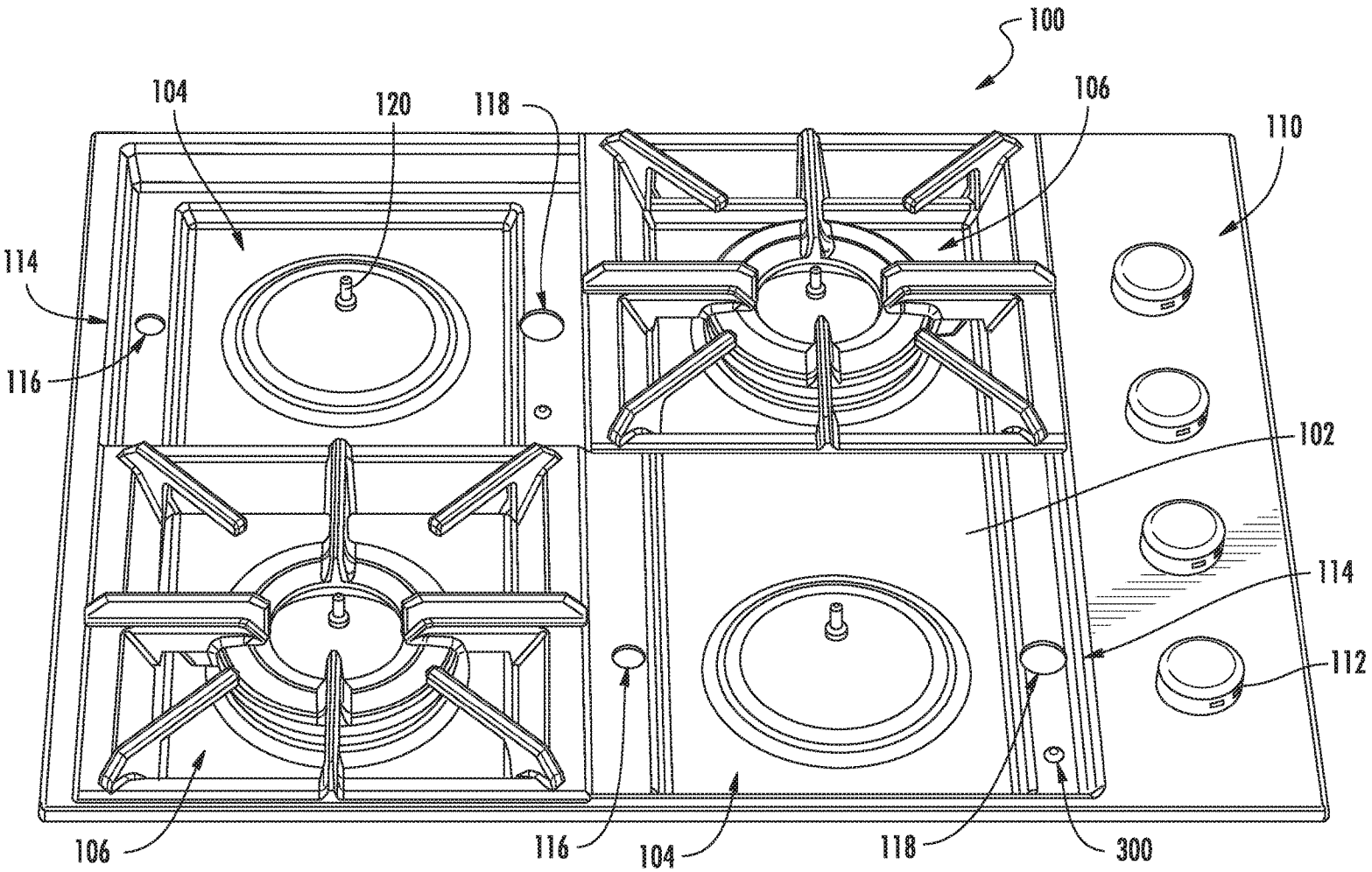
FIG. 3 provides a top, perspective view of the exemplary cooktop appliance embodiment of FIG. 1 wherein multiple burners are removed.

Although shown with multiple knobs 112, it should be understood that knobs 112 and the configuration of the cooktop appliance 100 shown in FIGS. 1 through 3 are provided by way of example only. More specifically, the user interface panel 110 may include various input components, such as one or more of a variety of touch-type controls, electrical, mechanical or electro-mechanical input devices including rotary dials, push buttons, and touch pads. The user interface panel 110 may include other display components, such as a digital or analog display device designed to provide operational feedback to a user. The user interface 110 may be in communication with the controller via one or more signal lines or shared communication busses. The user interface 110 may be located on a different surface of the appliance, for instance, an angled front edge or a vertical backsplash.

The cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies 200. Similarly, the present subject matter may be used in cooktop appliances that include an oven, i.e., range appliances.

As illustrated in FIG. 2, one or more of the burners 210 of the gas burner assemblies 200 may be selectively removed and/or replaced by another discrete burner(s) 210. In some exemplary embodiments, multiple burners 212, 214 of differing sizes may be selectively and separately provided at a single hob zone (e.g., at an interchangeable hob zone 104). During use or assembly, a first interchangeable burner 212 and a second interchangeable burner 214 may be selectively and separately placed on the interchangeable hob zone 104. The first interchangeable burner 212 may be configured to have a relatively high fuel output or flame size. By contrast, the second interchangeable burner 214 may be configured to have a relatively low fuel output or flame size. According to the desired use or user preference, the first interchangeable burner 212 may be selectively replaced by the second interchangeable burner 214 (and vice versa). In some exemplary embodiments, at least two interchangeable hob-zones 104 are provided. Optionally, one or more of remaining hob zones may be configured as fixed hob zones 106. In turn, only a select burner 210 may be provided at the fixed hob zone 106 (e.g., a burner configured to provide a fuel output or flame size between that of the relatively low and high burners).

Turning to FIGS. 3 through 6, each interchangeable hob zone 104 defines a fixed gas opening or receptacle 114. The first interchangeable burner 212 and the second interchangeable burner 214 may be selectively exchanged depending on the desired use or location of each burner 212, 214. Generally, both the first interchangeable burner 212 and second interchangeable burner 214 include a grate 220 defining an upper support area. For example, grate 220 includes a plurality of elongated members 222, e.g., formed of cast metal, such as cast iron. The cooking utensil may be placed on the elongated members 222 such that the cooking utensil rests on an upper surface of the elongated members 222. Moreover, each grate 220 may include an outer frame 224 that extends around or defines a perimeter of grate 220 and/or gas burner assembly 200. As shown in the present figures, the outer frame 224 and upper support areas of each grate 220 may be square or rectangular in certain exemplary embodiments. In additional or alternative embodiments, the upper support area of the first interchangeable burner 212 is substantially equal to the upper support area of the second interchangeable burner 214. The perimeter defined by the outer frame 224 for the first interchangeable burner 212 will be substantially the same as that of the second interchangeable burner 214. When disposed on the interchangeable hob zone 104, the one of the first interchangeable burner 212 or the second interchangeable burner 214 will connect to or extend through the fixed gas receptacle 114. In turn, fuel supplied to the fixed gas receptacle 114 may be directed to that same burner 212, 214. As used herein, values or attributes that are indicated as being "substantially equal" or "substantially the same" are understood to be within at least 10% of each other.

A gas flow switch 300 is disposed on the top panel 102 at the each interchangeable hob zone 104. Generally, each switch 300 is configured selectively engage one of the first interchangeable burner 212 or the second interchangeable burner 214. Upon engaging the first interchangeable burner 212 or the second interchangeable burner 214, the switch 300 may restrict fuel or gas flow to the burner 212, 214. In some exemplary embodiments, the switch 300 includes a plunger 310 that extends above the panel 102 to selectively engage an interchangeable burner 212, 214 at the same respective hob zone 104. A static igniter 120 may be disposed on the panel 102 (e.g., in the hob zone 104) to ignite fuel from any interchangeable burner 212, 214.

In certain exemplary embodiments, the fixed gas receptacle 114 includes one or more gas apertures 116, 118 directing a combustible fuel (e.g., natural gas, propane, etc.) from a fluid supply (not pictured) to a burner 212, 214 placed thereon. In some embodiments, the fixed gas receptacle 114 includes a primary gas aperture 116 and a discrete alternate gas aperture 118. During use of the appliance 100, fuel supplied to one or more of the primary gas aperture 116 or the alternate gas aperture 118 may be selectively varied. For instance, fuel may be supplied or restricted to either aperture 116, 118 according which interchangeable burner 212, 214 is disposed on the interchangeable hob zone 104, as will be described below.

Figure 4:
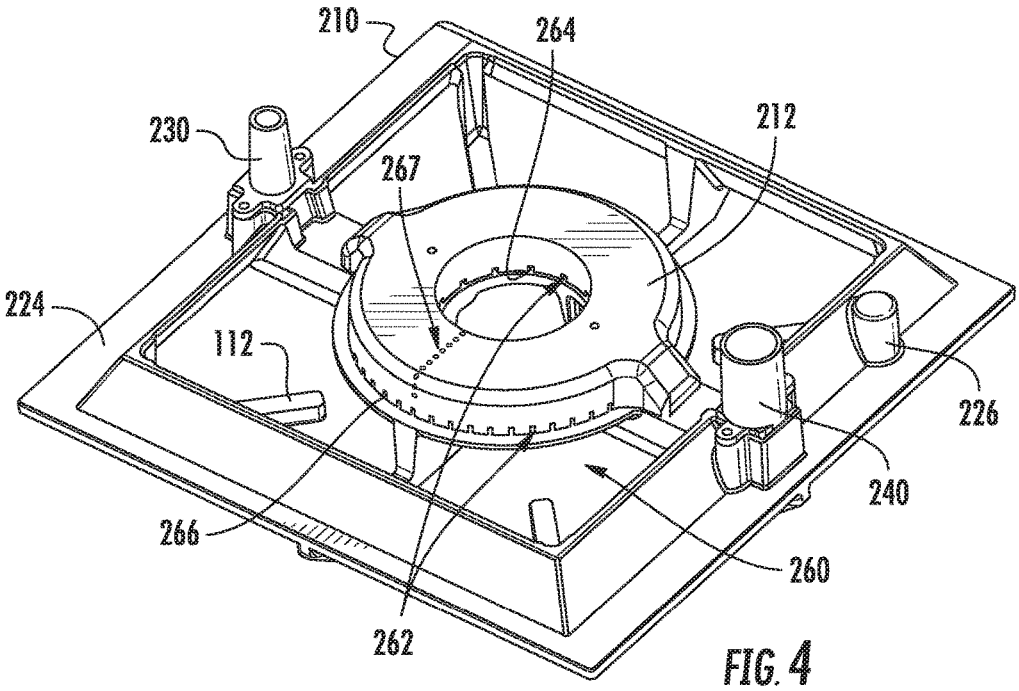
FIG. 4 provides a bottom, perspective view of an interchangeable burner according to an exemplary embodiment of the present subject matter.
Figure 5:
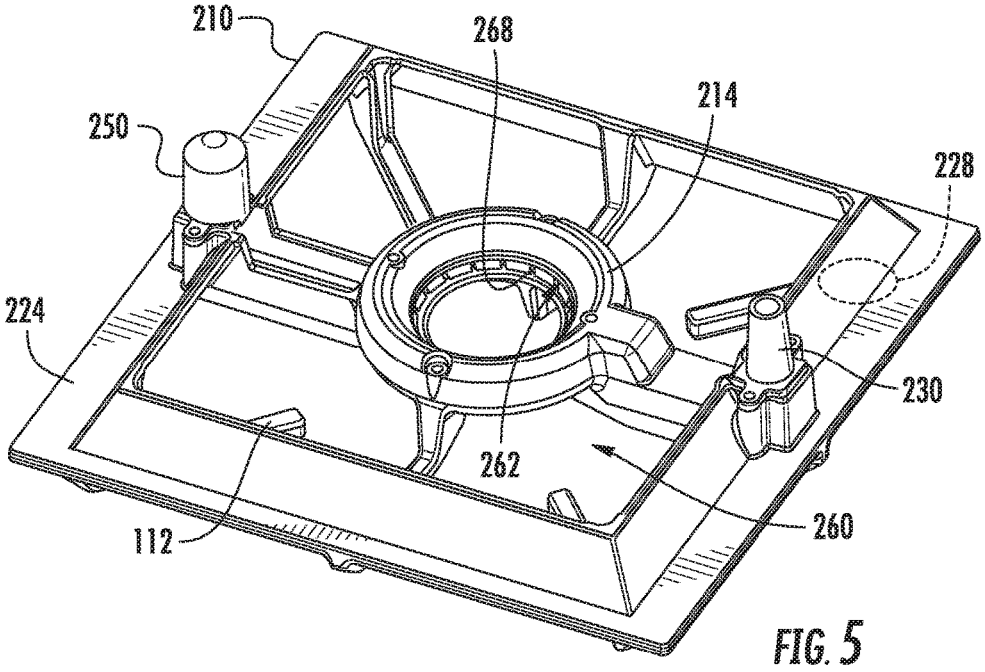
FIG. 5 provides a bottom, perspective view of another interchangeable burner according to an exemplary embodiment of the present subject matter.
Figure 6:
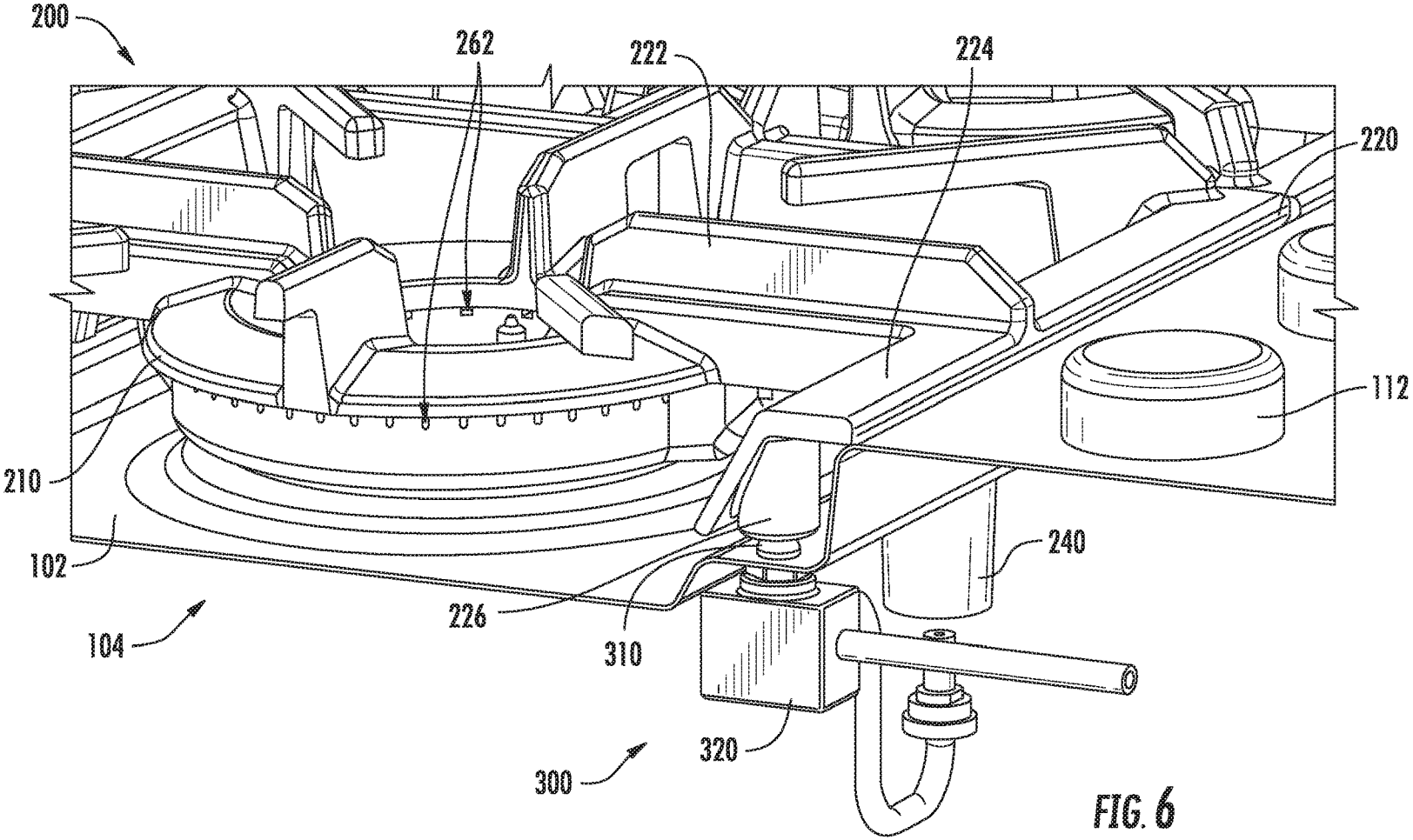
FIG. 6 provides a front, cross-sectional view of a cooktop appliance according to an exemplary embodiment of the present subject matter.

As illustrated in FIGS. 4 and 5, various discrete interchangeable burners 212, 214 may be provided. Generally, each burner 212, 214 includes one or more mixing tubes 230, 240. Fuel supplied from the conduit(s) 322, 324, e.g., at an orifice thereof, may entrain and mix with air as both pass through the mixing tube(s) 230, 240. After entering the mixing tube(s) 230, 240, entrained fuel and air enters the grate 220 through one or more fuel passages defined through the elongated member(s) 222. In turn, each fuel passage may extend from a mixing tube 230, 250 to an internal fuel channel 270 of the burner 212, 214.

In some exemplary embodiments, the mixing tube(s) 230, 240 may be Venturi tubes extending from the outer frame 224 to receive fuel passing through the fixed gas receptacle 114 (see FIG. 3). Each Venturi tube may define a tapered channel such that a pressure of the fuel and air decreases while a velocity of the fuel and air increases. In certain exemplary embodiments, the Venturi mixing tube(s) 230, 240 extend through at least one of the primary gas aperture 116 or the alternate gas aperture 118 (see FIG. 3). Each Venturi tube 230, 240 may be disposed directly above an orifice of a discrete conduit 322, 324. The first interchangeable burner 212 of some exemplary embodiments, e.g., the embodiment of FIG. 4, includes two discrete Venturi mixing tubes 230, 240 disposed at opposite sides of the outer frame 224. The second interchangeable burner 214 of additional exemplary embodiments, e.g., the embodiment of FIG. 5, includes a single Venturi mixing tube 230 to direct fuel to the burner 214. A non-communicating plug 250 is provided at the opposite side of the second interchangeable burner 214.

In some exemplary embodiments, each burner 212, 214 further includes a keyed segment 226, 228 at the outer frame 224 to selectively engage or avoid engagement with the gas flow switch 300. For instance, the burners 212, 214 may include one of a keyed male segment 226 or a keyed female segment 228. In specific embodiments, e.g., the embodiment of FIG. 4, the first interchangeable burner 212 includes a keyed male segment 226 that extends toward the panel 102 in activating-engagement with the switch 300 (e.g., at the plunger 310) when mounted to the respective interchangeable hob zone 104 (see FIGS. 3 and 6). In additional or alternative embodiments, e.g., as shown in FIG. 5, the second interchangeable burner 214 includes a keyed female segment 228 that receives a portion of the non-activated switch 300 (e.g., the plunger 310) when mounted to the respective interchangeable hob zone 104 (see FIG. 3).

In some exemplary embodiments, each burner 210 defines a distinct fuel output area 260 through which fuel may flow after entering a respective burner 210 at the mixing tube(s) 230, 240. Each fuel output area 260 includes a plurality of discrete flame ports 262. Upon fuel being ignited, the fuel output area 260 may thus define the shape and size of the flame provided by a respective burner 210. In specific embodiments, the fuel output area 260 of the burner 210 includes a burner ring 264, 266, 268 at which a substantially circular flame may be generated.

In exemplary embodiments of the first interchangeable burner 212, e.g., the embodiment of FIG. 4, the first interchangeable burner 212 defines a fuel output area 260 that includes an inner burner ring 264 and an outer burner ring 266. As shown, the outer burner ring 266 is positioned radially outward from the inner burner ring 264. As a result, the inner burner ring 264 may have a diameter that is smaller than the diameter of the outer burner ring 266. In exemplary embodiments the burner rings 264, 266 are configured as concentric circular rings (see FIG. 4). When mounted on the interchangeable hob zone 104, the inner burner ring 264 surrounds and faces the igniter 120. In turn, the igniter 120 is positioned radially inward from the inner burner ring 264. As shown, the outer burner ring 266 is disposed about the igniter 120 and the inner burner ring 264. The outer burner ring 266 faces away from the igniter 120 such that fuel, and thereby a flame, is directed radially outward from the burner 212. A portion of the burner 212 extends between the inner burner ring 264 and the outer burner ring 266 to define a channel through which, under which, or over which an ignited flame may pass. For example, as illustrated in FIG. 4, some exemplary embodiments include a plurality of flame-pass ports 267 defined through a bottom portion of a burner from the inner burner ring 264 to the outer burner ring 266. Fuel transmitted through the flame-pass ports 267 may be ignited in series to generate an ignition flame between the inner burner ring 264 and the outer burner ring 266.

In some exemplary embodiments, the second interchangeable burner 214 includes a single burner ring 268 that, when mounted to the interchangeable hob zone 104, surrounds and faces the igniter 120. The overall fuel output area 260 of the second interchangeable burner 214 is generally smaller than that of the first interchangeable burner 212 of FIG. 4. Nonetheless, in certain exemplary embodiments the size of the burner ring 268 of the second interchangeable burner 214 is substantially the same as the size of the inner burner ring 264 of the first interchangeable burner 212. In exemplary embodiments, both burner rings 266, 268 define substantially identical or equal inner diameters. When each of the first interchangeable burner 212 and the second interchangeable burner 214 are mounted to the interchangeable hob zone 104, the igniter 120 may be positioned at substantially the same distance from the inner burner ring 264 as from the burner ring 268 of the second interchangeable burner 214.

Returning to FIGS. 3 and 6, the gas flow switch 300 includes a valve 320 disposed in communication with the fixed gas receptacle 114, at location upstream therefrom. An alternate supply conduit 324 and/or a primary supply conduit 322 may extend from the valve 320 to the fixed gas receptacle 114. Specifically, the alternate supply conduit 324 extends to an alternate gas aperture 118, while the primary supply conduit 322 extends to the primary gas aperture 116. The valve 320 may be mechanically linked to the plunger 310 and configured to selectively restrict or permit the flow of fuel through the alternate and/or primary supply conduits 322. In specific embodiments, flow through the alternate supply conduit 324 (i.e., to the alternate gas aperture 118) is permitted according to whether the gas flow switch 300 has been engaged (e.g., by a keyed male segment). For instance, in some exemplary embodiments, the valve 320 is opened in response to the switch 300 being engaged by the keyed male segment 226. An increased amount of fuel may subsequently be directed to the fixed gas receptacle 114 at the alternate gas aperture 118. The valve 320 may be provided as a suitable two-port or three-port valve, such as, e.g., a gate valve, globe valve, diaphragm valve, etc. Moreover, although the switch 300 is illustrated as including a slidable plunger 310 that mechanically drives the valve 320, another suitable mechanical or electronic proximity switch may be provided in additional or alternative embodiments.

Figure 7:
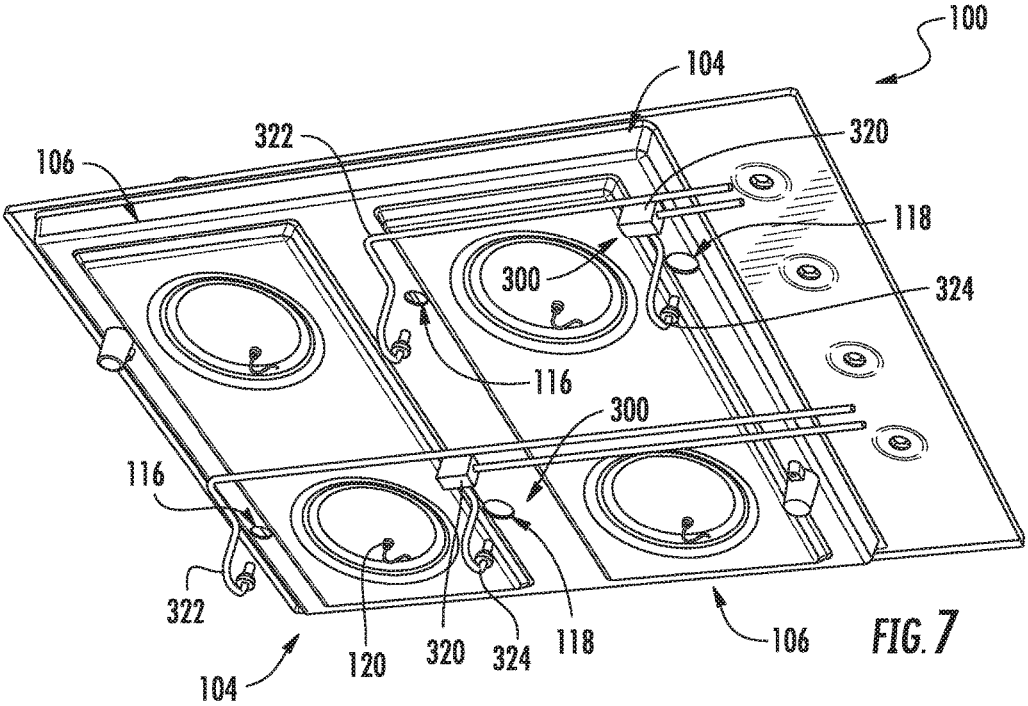
FIG. 7 provides a bottom, perspective view the exemplary cooktop appliance according to the exemplary embodiment of FIG. 6.
Figure 8:
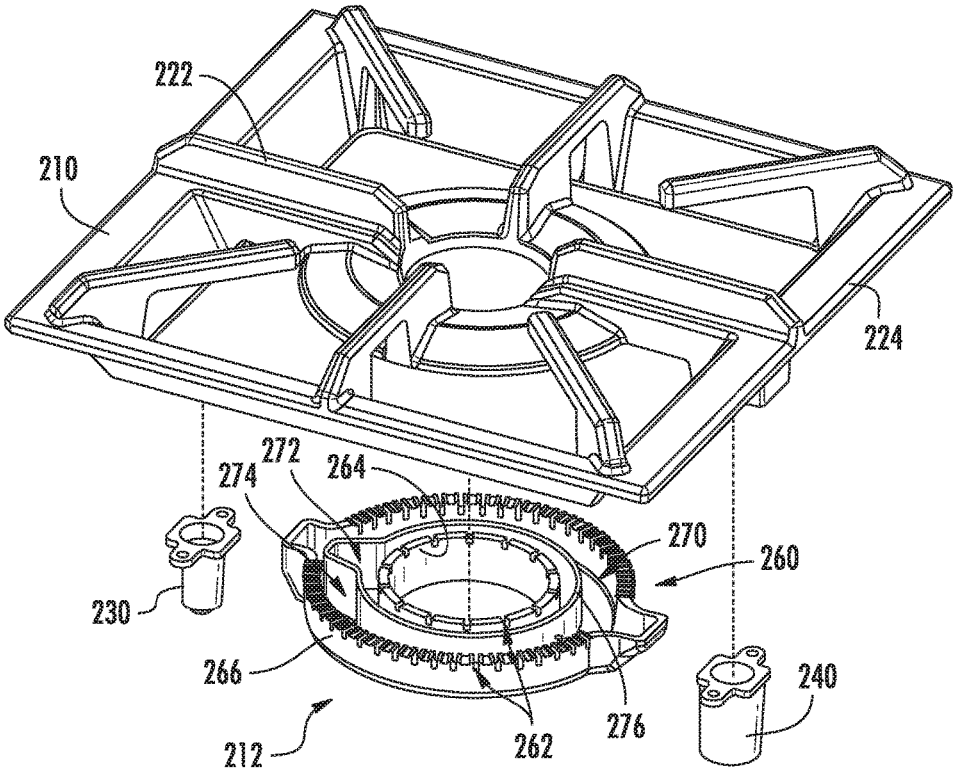
FIG. 8 provides an exploded, perspective view of an interchangeable burner for the exemplary embodiment of FIG. 7.

Turning to FIGS. 7 and 8, some exemplary embodiments of the appliance includes a plurality of discrete supply conduits 322, 324. In certain exemplary embodiments, a primary supply conduit 322 extends from a fuel supply (not shown) toward the primary gas aperture 116. An alternate supply conduit 324 extends from the fuel supply (not shown) to the alternate gas aperture 118, independently from the primary gas aperture 116. The valve 320 is coupled to the alternate supply conduit 324, upstream from the alternate gas aperture 118. Whether fuel is permitted through the alternate supply conduit 324 can be determined on whether the switch 300 is engaged. For instance, in exemplary embodiments, when the relatively large first interchangeable burner 212 is placed on an interchangeable hob zone 104, the valve 320 will be opened. Fuel will be permitted through the alternate supply conduit 324 to the alternate gas aperture 118. When the relatively small second interchangeable burner 214 (see FIG. 2) is placed on the interchangeable hob zone 104, the valve 320 will be closed to prevent fuel to the alternate gas aperture 118. Fuel to the primary supply conduit 322 is independent of the valve 320. The gas flow switch 300 may, thus, be configured to open or close upon engagement with one of the first interchangeable burner 212 or the second interchangeable burner 214 (see FIG. 2).

In some such embodiments, the first interchangeable burner 212 will include two separate Venturi mixing tubes 230, 240, as shown in FIG. 8. Each mixing tube 230, 240 feeds a separate fuel channel 272, 274 defined within the burner 212. One mixing tube 230 is sized to fit within the primary gas aperture 116. Fuel from the primary supply conduit 322 is, thus, directed from the first mixing tube 230 to the inner fuel channel 272 before exiting the first interchangeable burner 212 at the inner burner ring 264. The second or opposite mixing tube 240 is sized to fit within the alternate gas aperture 118. Fuel from the alternate supply conduit 324 is, thus, directed from the second mixing tube 240 to the outer fuel channel 274 before exiting the first interchangeable burner 212 at the outer burner ring 266. An isolating wall 276 extends within the burner 212, effectively separating the inner and outer fuel channels 272, 274, and preventing the flow of fuel therebetween. During use, the flow of fuel to the inner and outer burner rings 264, 266 may be controlled independently.

Figure 9:
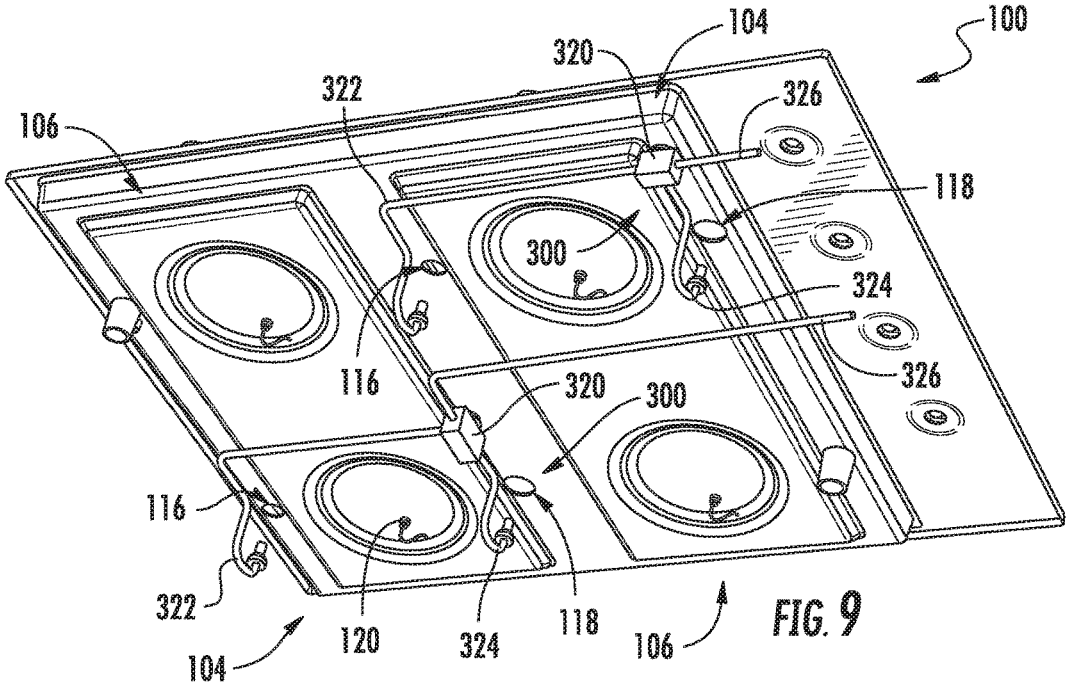
FIG. 9 provides a bottom, perspective view of a cooktop appliance according to another exemplary embodiment of the present subject matter.
Figure 10:
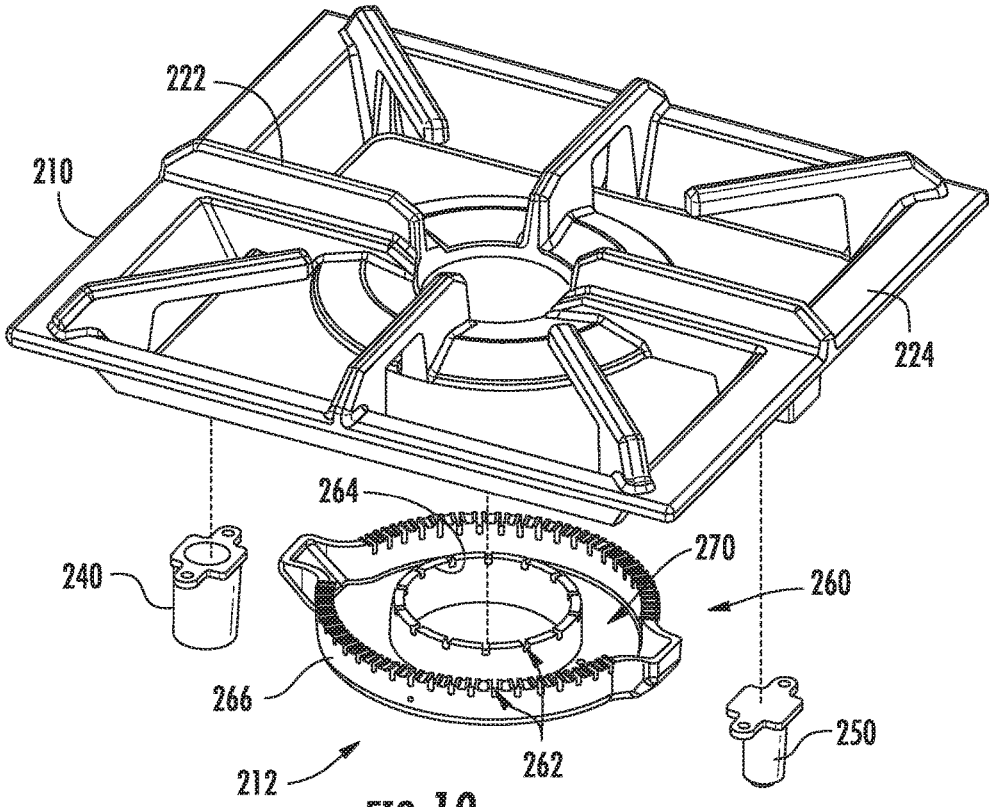
FIG. 10 provides an exploded, perspective view of an interchangeable burner for the exemplary embodiment of FIG. 9.

Turning to FIGS. 9 and 10, exemplary embodiments of the appliance include a plurality of branched supply conduits 322, 324. In some embodiments, an initial conduit 326 extends from a fuel supply (not shown) to the valve 320 and supplies fuel to the valve 320. The primary supply conduit 322 and alternate supply conduit 324 each extend from the valve 320, downstream from the initial conduit 326. Each of the primary supply conduit 322 and the alternate supply conduit 324 are disposed in selective fluid communication with the initial conduit 326 according to the position of the valve 320. Specifically, the primary supply conduit 322 extends from a fuel supply (not shown) toward the primary gas aperture 116. An alternate supply conduit 324 extends from the fuel supply (not shown) to the alternate gas aperture 118, independently from the primary gas aperture 116. Whether fuel is permitted through the alternate supply conduit 324 or the primary supply conduit 322 can be determined on whether the switch 300 is engaged.

For instance, in exemplary embodiments, when the relatively large first interchangeable burner 212 is placed on an interchangeable hob zone 104, fuel through the alternate supply conduit 324 will be permitted. In optional alternative embodiments, fuel may also be simultaneously supplied through the primary supply conduit 322. When the relatively small second interchangeable burner 214 (see FIG. 2) is placed on the interchangeable hob zone 104, the valve 320 will be closed to prevent fuel to the alternate gas aperture 118. Fuel will be permitted to flow exclusively through the primary supply conduit 322. The gas flow switch 300 may, thus, be configured to open or close upon engagement with one of the first interchangeable burner 212 or the second interchangeable burner 214 (see FIG. 2).

In some such embodiments, the first interchangeable burner 212 will include a single Venturi mixing tube 240, as shown in FIG. 10. The single mixing tube 240 feeds a fuel channel 270 defined within the burner 212. As result, the one mixing tube 240 is sized to fit within the alternate gas aperture 118. Fuel from the primary supply conduit 322 is, thus, directed from the mixing tube 240 to the unitary fuel channel 270 before being distributed between the inner burner ring 264 and the outer burner ring 266. A non-communicating plug 250 is disposed opposite from the mixing tube 240 to extend through the primary gas aperture 116 and further orient the grate 220. During use, fuel flow to the inner burner ring 264 and the outer burner ring 266 may, thus, be controlled simultaneously.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop comprising:

a first hob zone including a fixed gas receptacle;

a first interchangeable burner being selectively positionable at the first hob zone to operably communicate with the fixed gas receptacle, the first interchangeable burner defining a fuel output area;

a second interchangeable burner being selectively positionable at the first hob zone to operably communicate with the fixed gas receptacle, the second interchangeable burner defining a fuel output area smaller than the fuel output area of the first interchangeable burner; and a first gas flow switch disposed at the first hob zone to selectively engage one of the first interchangeable burner or the second interchangeable burner, the first gas flow switch including a valve upstream of the fixed gas receptacle to selectively restrict gas flow upon engagement of the first gas flow switch with one of the first interchangeable burner or the second interchangeable burner, wherein the fixed gas receptacle includes a primary gas aperture and a discrete alternate gas aperture, and wherein the first gas flow switch is configured to restrict fuel to the alternate gas aperture upon engagement with one of the first interchangeable burner or the second interchangeable burner, or permit fuel to the primary aperture upon engagement with one of the first interchangeable burner or the second interchangeable burner.

2. The cooktop of claim 1, wherein the first interchangeable burner includes a grate defining an upper support area, and wherein the second interchangeable burner includes a grate having an upper support area substantially equal to the upper support area of the first interchangeable burner.

3. The cooktop of claim 1, further comprising:

a second hob zone including a second fixed gas receptacle, wherein the first interchangeable burner and the second interchangeable burner are separately and selectively positionable at the second hob zone; and a second gas flow switch disposed at the second hob zone to selectively engage one of the first interchangeable burner or the second interchangeable burner, the second gas flow switch including a valve upstream of the second fixed gas receptacle to selectively restrict gas flow upon engagement of the second gas flow switch with one of the first interchangeable burner or the second interchangeable burner.

4. The cooktop of claim 1, wherein at least one of the first interchangeable burner or the second interchangeable burner includes a plug to extend through a portion of the fixed gas receptacle.

5. The cooktop of claim 1, wherein the first hob zone includes a static igniter to ignite gas from the first interchangeable burner and the second interchangeable burner, wherein the fuel output area of the second interchangeable burner includes a burner ring, and wherein the igniter of the first hob zone is positioned radially inward from the burner ring upon positioning of the second interchangeable burner at the first hob zone.

6. The cooktop of claim 1, wherein the first hob zone includes a static igniter to ignite gas from the first interchangeable burner and the second interchangeable burner, wherein the fuel output area of the first interchangeable burner includes an inner burner ring and an outer burner ring, and wherein the igniter of the first hob zone is positioned radially inward from the inner burner ring and the outer burner ring upon positioning of the first interchangeable burner at the first hob zone.

7. The cooktop of claim 1, wherein one of the first interchangeable burner or the second interchangeable burner includes a keyed male segment to actuate the first gas switch upon positioning of the one of the first interchangeable burner or the second interchangeable burner at the first hob zone, and wherein the other of the first interchangeable burner or the second interchangeable burner defines a keyed female segment to receive the first gas switch upon positioning of the other of the first interchangeable burner or the second interchangeable burner at the first hob zone.

8. A cooktop comprising:

a first hob zone including a fixed gas receptacle;

a first interchangeable burner being selectively positionable at the first hob zone to operably communicate with the fixed gas receptacle, the first interchangeable burner defining a fuel output area;

a second interchangeable burner being selectively positionable at the first hob zone to operably communicate with the fixed gas receptacle, the second interchangeable burner defining a fuel output area smaller than the fuel output area of the first interchangeable burner; and a first gas flow switch disposed at the first hob zone to selectively engage one of the first interchangeable burner or the second interchangeable burner, the first gas flow switch including a valve upstream of the fixed gas receptacle to selectively restrict gas flow upon engagement of the first gas flow switch with one of the first interchangeable burner or the second interchangeable burner, wherein the first hob zone includes a static igniter to ignite gas from the first interchangeable burner and the second interchangeable burner, wherein the fuel output area of the first interchangeable burner includes an inner burner ring and an outer burner ring, and wherein the igniter of the first hob zone is positioned radially inward from the inner burner ring and the outer burner ring upon positioning of the first interchangeable burner at the first hob zone.

9. The cooktop of claim 8, wherein the fuel output area of the second interchangeable burner includes a burner ring, and wherein the igniter of the first hob zone is positioned radially inward from the burner ring upon positioning of the second interchangeable burner at the first hob zone.

10. The cooktop of claim 8, wherein the first interchangeable burner includes a grate defining an upper support area, and wherein the second interchangeable burner includes a grate having an upper support area substantially equal to the upper support area of the first interchangeable burner.

11. The cooktop of claim 8, further comprising:

a second hob zone including a second fixed gas receptacle, wherein the first interchangeable burner and the second interchangeable burner are separately and selectively positionable at the second hob zone; and a second gas flow switch disposed at the second hob zone to selectively engage one of the first interchangeable burner or the second interchangeable burner, the second gas flow switch including a valve upstream of the second fixed gas receptacle to selectively restrict gas flow upon engagement of the second gas flow switch with one of the first interchangeable burner or the second interchangeable burner.

12. The cooktop of claim 8, wherein the fixed gas receptacle includes a primary gas aperture and a discrete alternate gas aperture, and wherein the second interchangeable burner includes a plug to extend through a portion of the fixed gas receptacle.

13. The cooktop of claim 8, wherein the fixed gas receptacle includes a primary gas aperture and a discrete alternate gas aperture, wherein the first gas flow switch is configured to restrict fuel to the alternate gas aperture upon engagement with the second interchangeable burner.

14. The cooktop of claim 8, wherein the fixed gas receptacle includes a primary gas aperture and a discrete alternate gas aperture, wherein the first gas flow switch is configured to permit fuel to the primary aperture upon engagement with one of the first interchangeable burner.

15. The cooktop of claim 8, wherein one of the first interchangeable burner or the second interchangeable burner includes a keyed male segment to actuate the first gas switch upon positioning of the one of the first interchangeable burner or the second interchangeable burner at the first hob zone, and wherein the other of the first interchangeable burner or the second interchangeable burner defines a keyed female segment to receive the first gas switch upon positioning of the other of the first interchangeable burner or the second interchangeable burner at the first hob zone.

16. A cooktop comprising:

a first hob zone including a fixed gas receptacle;

a first interchangeable burner being selectively positionable at the first hob zone to operably communicate with the fixed gas receptacle, the first interchangeable burner defining a fuel output area;

a second interchangeable burner being selectively positionable at the first hob zone to operably communicate with the fixed gas receptacle, the second interchangeable burner defining a fuel output area smaller than the fuel output area of the first interchangeable burner; and a first gas flow switch disposed at the first hob zone to selectively engage one of the first interchangeable burner or the second interchangeable burner, the first gas flow switch including a valve upstream of the fixed gas receptacle to selectively restrict gas flow upon engagement of the first gas flow switch with one of the first interchangeable burner or the second interchangeable burner, wherein one of the first interchangeable burner or the second interchangeable burner includes a keyed male segment to actuate the first gas switch upon positioning of the one of the first interchangeable burner or the second interchangeable burner at the first hob zone, and wherein the other of the first interchangeable burner or the second interchangeable burner defines a keyed female segment to receive the first gas switch upon positioning of the other of the first interchangeable burner or the second interchangeable burner at the first hob zone.

17. The cooktop of claim 16, wherein the first interchangeable burner includes a grate defining an upper support area, and wherein the second interchangeable burner includes a grate having an upper support area substantially equal to the upper support area of the first interchangeable burner.

18. The cooktop of claim 16, further comprising:

a second hob zone including a second fixed gas receptacle, wherein the first interchangeable burner and the second interchangeable burner are separately and selectively positionable at the second hob zone; and a second gas flow switch disposed at the second hob zone to selectively engage one of the first interchangeable burner or the second interchangeable burner, the second gas flow switch including a valve upstream of the second fixed gas receptacle to selectively restrict gas flow upon engagement of the second gas flow switch with one of the first interchangeable burner or the second interchangeable burner.

19. The cooktop of claim 16, wherein the first hob zone includes a static igniter to ignite gas from the first interchangeable burner and the second interchangeable burner, wherein the fuel output area of the second interchangeable burner includes a burner ring, and wherein the igniter of the first hob zone is positioned radially inward from the burner ring upon positioning of the second interchangeable burner at the first hob zone.

20. The cooktop of claim 16, wherein the first hob zone includes a static igniter to ignite gas from the first interchangeable burner and the second interchangeable burner, wherein the fuel output area of the first interchangeable burner includes an inner burner ring and an outer burner ring, and wherein the igniter of the first hob zone is positioned radially inward from the inner burner ring and the outer burner ring upon positioning of the first interchangeable burner at the first hob zone.

* * * * *